US007484936B2

(12) United States Patent
Bouchard et al.

(10) Patent No.: US 7,484,936 B2
(45) Date of Patent: Feb. 3, 2009

(54) BLADES FOR A GAS TURBINE ENGINE WITH INTEGRATED SEALING PLATE AND METHOD

(75) Inventors: Guy Bouchard, Mont St-Hllaire (CA); Ronald Trumper, St-Bruno (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 464 days.

(21) Appl. No.: 11/234,177

(22) Filed: Sep. 26, 2005

(65) Prior Publication Data

US 2007/0258816 A1 Nov. 8, 2007

(51) Int. Cl.
*F01D 11/00* (2006.01)

(52) U.S. Cl. ..... 416/193 R; 415/173.3; 415/174.3; 416/193 A; 416/220 R; 416/221

(58) Field of Classification Search ..... 415/173.1, 415/173.3, 174.3; 416/193 R, 220 R, 221
See application file for complete search history.

(56) References Cited

U.S. PATENT DOCUMENTS

| | | | | |
|---|---|---|---|---|
| 3,501,249 | A | 3/1970 | Scalzo et al. | |
| 3,656,865 | A | 4/1972 | Spears, Jr. | |
| 3,728,042 | A | 4/1973 | Hugoson et al. | |
| 3,748,060 | A | 7/1973 | Hugoson et al. | |
| 3,807,898 | A | 4/1974 | Guy et al. | |
| 3,814,539 | A | 6/1974 | Klompas | |
| 3,853,425 | A | 12/1974 | Scalzo et al. | |
| 3,887,298 | A | 6/1975 | Hess et al. | |
| 4,021,138 | A | 5/1977 | Scalzo et al. | |
| 4,192,633 | A * | 3/1980 | Herzner | 416/221 |
| 4,279,572 | A | 7/1981 | Auriemma | |
| 4,304,523 | A * | 12/1981 | Corsmeier et al. | 416/221 |
| 4,326,835 | A | 4/1982 | Wertz | |
| 4,659,285 | A | 4/1987 | Kalogeros et al. | |
| 4,730,983 | A | 3/1988 | Naudet et al. | |
| 5,228,835 | A | 7/1993 | Chlus | |
| 5,256,035 | A | 10/1993 | Norris et al. | |
| 6,077,035 | A | 6/2000 | Walters et al. | |
| 6,190,131 | B1 * | 2/2001 | Deallenbach | 416/144 |
| 6,273,683 | B1 | 8/2001 | Zagar et al. | |
| 6,561,764 | B1 | 5/2003 | Tiemann | |
| 2004/0062643 | A1 * | 4/2004 | Brauer et al. | 415/173.7 |

* cited by examiner

*Primary Examiner*—Igor Kershteyn
(74) *Attorney, Agent, or Firm*—Ogilvy Renault LLP

(57) ABSTRACT

A blade for a rotor assembly including a root portion, a platform with an overhang, an airfoil portion and a sealing plate. The sealing plate protrudes from the blade along a circumferential direction.

2 Claims, 3 Drawing Sheets

BLADES FOR A GAS TURBINE ENGINE WITH INTEGRATED SEALING PLATE AND METHOD

TECHNICAL FIELD

The present invention relates generally to gas turbine engines and, more particularly, to improved rotor blades of such engines and a method related thereto.

BACKGROUND OF THE ART

A conventional gas turbine engine is generally provided with one or more rotor assemblies with a disc and a circumferential array of blades. The rotor blades are disposed in corresponding retention slots of the disc with a radially extending gap between adjacent blades to accommodate thermal expansion. These rotor assemblies are used in the turbine section, the compressor section, or both. The blades are often provided with internal cooling channels, especially when used in the turbine section.

In some engine designs, the gaps between the blades can be substantial and conventional cover plates mounted on the rotor disc generally do not adequately seal this area. Cooling air can leak through these radial gaps and the blades, which produce an impeller effect due to their extremely high rotational speed, expel the cooling air radially through the gaps. This transverse cooling air leakage flow impedes and disturbs the gas path flow and can significantly reduce the gas turbine engine efficiency.

It is known to provide an annular ring located between the cover plate and the disc in effort to deflect the cooling air flow away from the gaps and redirect it into the gas path in the direction of the gas path flow. However, such a ring can be subject to unwanted movement or be misplaced during assembly or maintenance, thereby reducing its efficiency. Moreover, damage at one point of the ring necessitates the replacement of the entire ring.

Accordingly, there is a need for an improved rotor blade and method where air leakage through the gaps between adjacent blades is mitigated.

SUMMARY OF THE INVENTION

It is therefore an aim of the present invention to provide an improved rotor blade for reducing cooling air leakage through gaps between adjacent blades.

In one aspect, the present invention provides a blade for use in a rotor assembly of a gas turbine engine, the blade comprising: a root portion; a platform connected over the root portion and including an overhang extending frontward of the root portion; an airfoil portion extending from the platform opposite of the root portion; and a sealing plate including interconnected axial and radial portions, the axial and radial portions being connected in a circumferentially offset manner respectively to an underside of the overhang and to a front side of the platform, the sealing plate protruding from the blade along a circumferential direction.

In another aspect, the present invention provides a rotor assembly for use in a gas turbine engine, the rotor assembly comprising: a disc with a plurality of slots evenly distributed along a circumferential direction of the disc; a plurality of blades, each of the blades having a root portion retained in a corresponding one of the slots, a platform connected over the root portion and an airfoil portion extending from the platform into an annular gas path, the platform of each of the blades being spaced apart from the platform of an adjacent one of the blades to define a gap therebetween; and a deflector composed of a plurality of sealing plates, each of the sealing plates including interconnected axial and radial portions, the axial and radial portions being connected to each of the blades in a circumferentially offset manner and extending in front of the adjacent one of the blades to cover the gap.

In another aspect, the present invention provides a blade for use in a rotor assembly of a gas turbine engine, the blade comprising: a root portion; a platform connected over the root portion; an airfoil portion extending from the platform opposite of the root portion; and means for covering a gap between the blade and an adjacent blade in the rotor assembly, the means for covering the gap being provided on the blade.

In another aspect, the present invention provides a method for forming a deflector diverting a leakage cooling air flow away from gaps between adjacent blades in a gas turbine rotor assembly, the method comprising the steps of: connecting a sealing plate in a circumferentially offset manner to each of the blades with the sealing plate protruding from the blade along a circumferential direction; and connecting the blades to a rotor disc such that the blades extend radially from the disc, the deflector being formed when the sealing plate of each of the blades extend in front an adjacent one of the blades.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
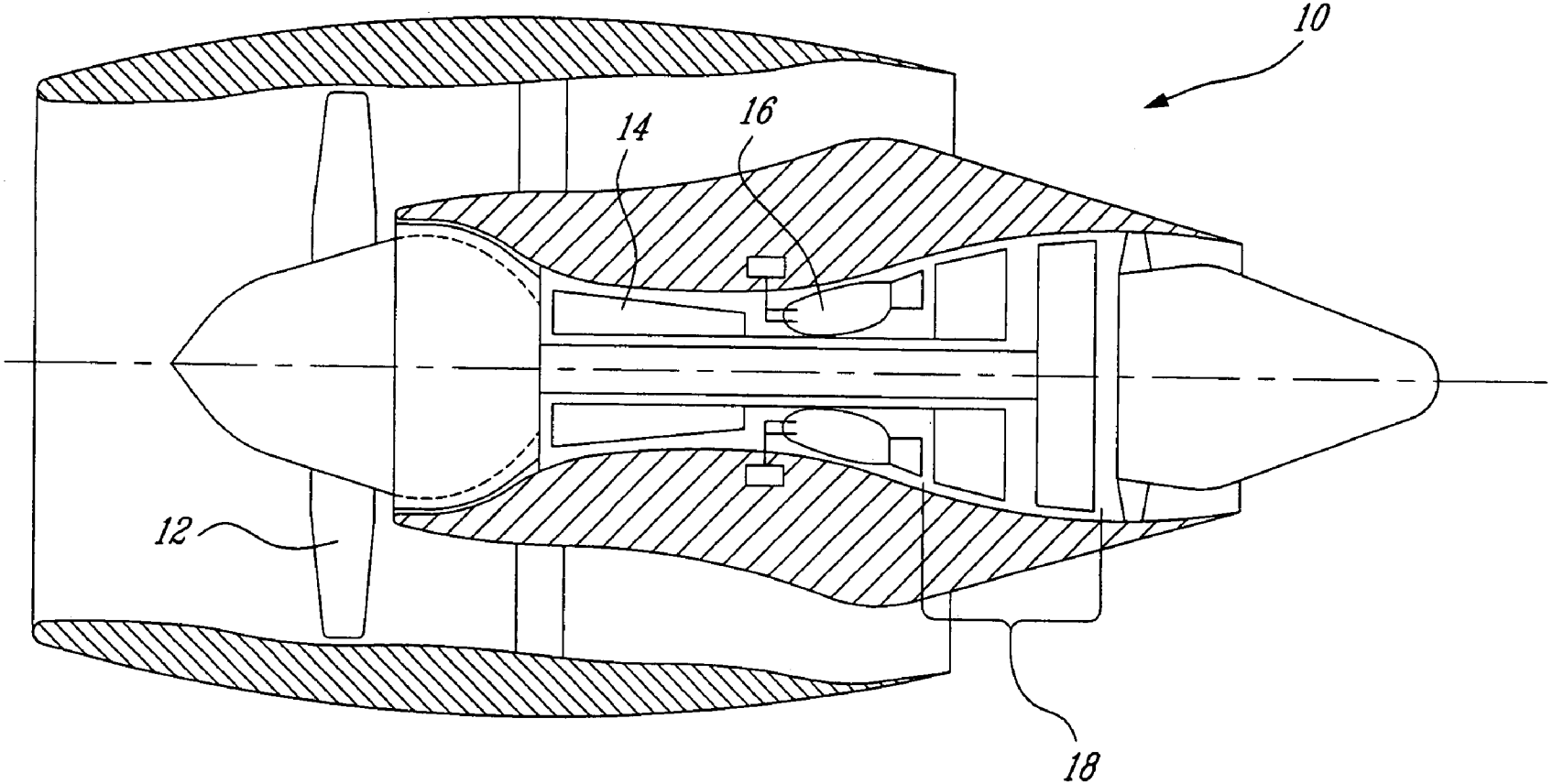
FIG. 1 is a schematic side view of a gas turbine engine, showing an example of a gas turbine engine in which the rotor blade and the method can be used.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
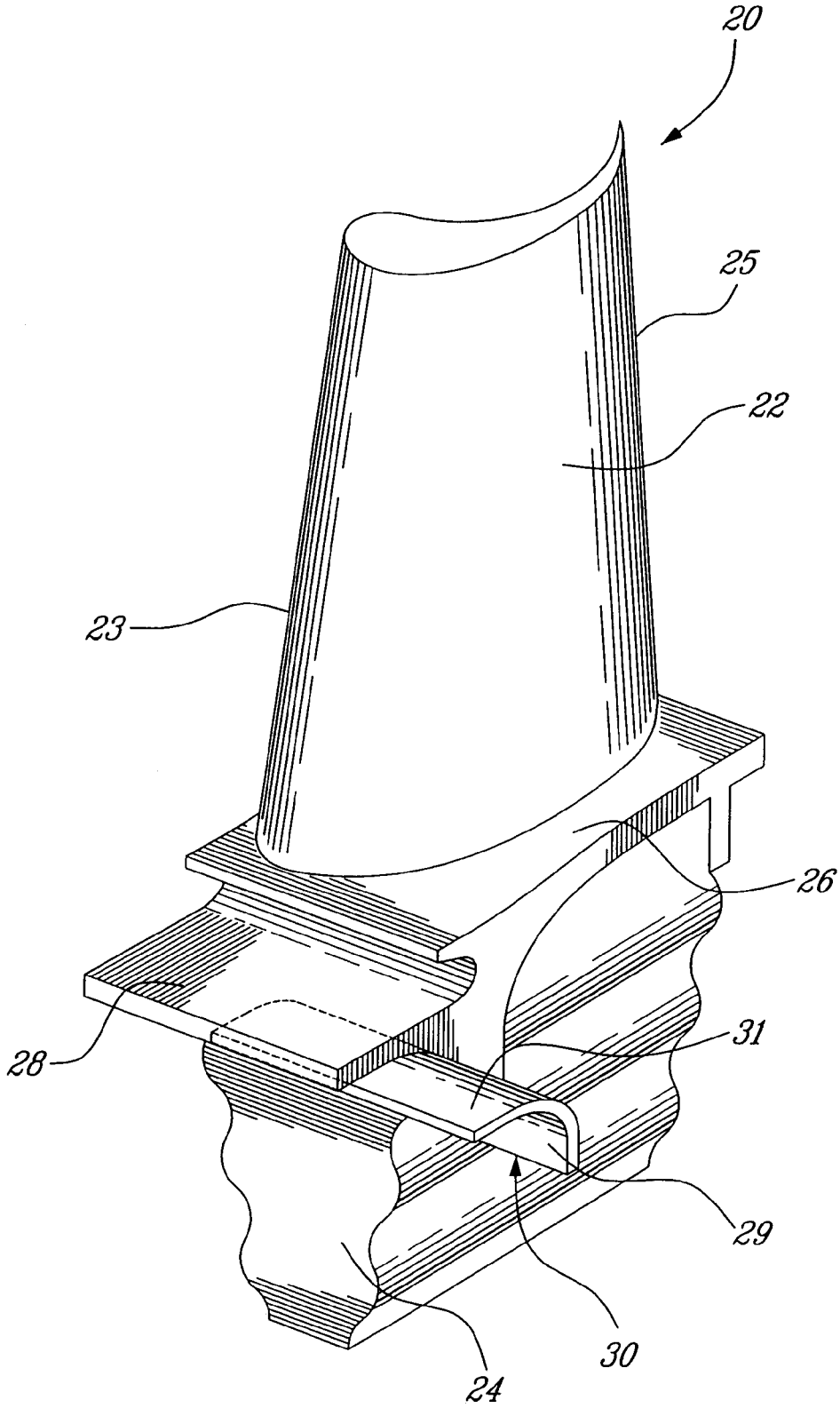
FIG. 2 is a perspective view of a rotor blade according to a preferred embodiment.
Figure 3:
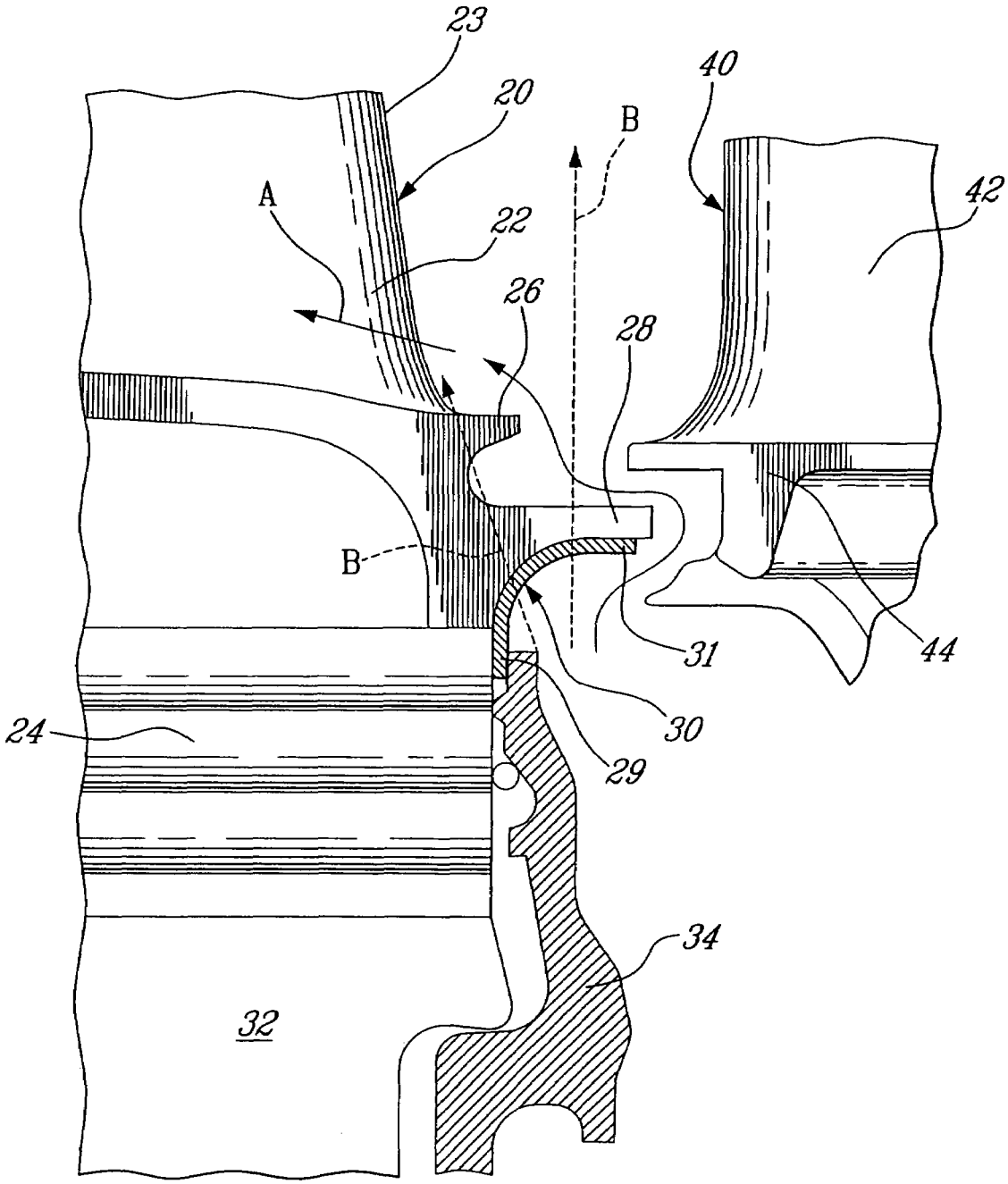
FIG. 3 is a partial side view in cross-section of the rotor blade of FIG. 2 installed in a rotor disc.

Referring to FIGS. 2-3, a rotor blade 20 for use in the turbine section 18 is shown. The rotor blade 20 includes an airfoil portion 22, a platform 26 and a blade root 24. It is to be understood that the rotor blade 20 can also be used in a variety of other rotors such as, for example, rotors of the compressor 14.

The blade root 24 is shaped to correspond with one of a plurality of circumferentially distributed slots in a rotor disc 32. The platform 26 has an underside connected to the blade root 24, and a top side connected to the airfoil portion 22, such that when the blade 20 is inserted in the slot of the disc 32, leading and trailing edges 23, 25 of the airfoil portion 22 are generally oriented toward respectively a front and back side of the disc 32. The platform 26 includes an overhang 28 extending frontward of the root portion 24. The platform 26 and overhang 28 have a width (defined along the circumferential direction of the disc 32) sized to provide a gap between adjacent platforms of adjacent blades, such as to accommodate thermal expansion. The platform 26 and overhang 28 also have a curvature corresponding to cylindrical surfaces concentric with the circular shape of the disc 32.

The blade 20 also comprises a sealing plate 30. The illustrated sealing plate 30 includes a radial portion 29 and an axial portion 31 which are connected to form a L-shaped profile, and has a length of at most half of the sum of the width of the gap and of the platform 26. The axial portion 31 of the sealing plate 30 has a curvature corresponding with an underside of the overhang 28 and is connected thereto in a circumferentially offset manner to extend along the circumferential direction of the disc 32. Similarly, the radial portion 29 has a shape corresponding to a front side of platform 26 and is connected thereto in the circumferentially offset manner to extend along the circumferential direction of the disc 32. It is possible to also similarly connect the radial portion 29 to a front side of the root portion 24. The sealing plate 30 protrudes from the platform 26, the radial and axial portions 29, 31 abutting an adjacent blade respectively at a front side of a platform thereof and an underside of a overhang thereof. Thus, the sealing plate 30 effectively covers a front portion of the gap between the adjacent blades. Preferably, the sealing plate 30 is connected to the platform 26 along one half of the width of the platform 26, but a number of other circumferentially offset configurations are possible, provided that the gap is effectively covered by the sealing plate 30.

Once installed in the rotor disc 32, the length of the sealing plate 30 is preferably such that sealing plates of adjacent blades are in proximity of each other to create an annular deflector, adjacent sealing plates being separated only by a gap sized to accommodate thermal expansion therebetween. However, smaller sealing plates 30 are also possible, provided that the gap is effectively covered. Moreover, the sealing plate 30 is preferably permanently connected to the platform 26, through welding, brazing or the like. It is also possible to have the sealing plate 30 integral with the blade platform 26.

In use, as shown in FIG. 3, the blades 20 are retained to the disc 32 with the help of a cover plate 34, which is concentric with the disc 32 and preferably abuts a lower end of the sealing plate 30 to maximize the sealing. The sealing plate 30 deviates the leakage air flow coming along a front side of the cover plate 34 around the sealing plate 30, into a conduit formed by a space between the blade platform 26 and a platform and vane 44, 42 of an adjacent stator assembly 40, and into the gas path at an upstream location with reference to the blade 20, as indicated by arrows A. Arrows B, in broken lines, indicate the disturbing flow of cooling air leakage which would be present without the sealing plate 30.

The sealing plate 30, by effectively covering a front portion of the gap, thus deviates the leakage airflow away therefrom, reducing the disturbance to the gas path flow and improving engine efficiency. Because the sealing plate 30 is rigidly fixed to the blade 20, it will not move in relation to the blade 20 during use or maintenance operations. If the sealing plate is damaged at one point, it can be repaired or changed without the need to remove the remaining sealing plates.

The above description is meant to be exemplary only, and one skilled in the art will recognize that changes may be made to the embodiments described without department from the scope of the invention disclosed. For example, the rotor blade described herein can be used in any other appropriate type of rotor, including but not limited to a compressor rotor of a gas turbine engine. Also, it is possible to provide a sealing plate 30 having a smooth arcuate profile with one extremity of the profile connected to the overhang 28 and another to the front of the platform 26 or of the root portion 24. Although the sealing plate 30 is preferably manufactured from the same material as the blade platform 26, the use of a different appropriate material is also possible.

Still other modifications which fall within the scope of the present invention will be apparent to those skilled in the art, in light of a review of this disclosure, and such modifications are intended to fall within the appended claims.

What is claimed is:

1. A method for forming a deflector diverting a leakage cooling air flow away from gaps between adjacent blades in a gas turbine rotor assembly, the method comprising the steps of:

connecting a sealing plate in a circumferentially offset manner to each of the blades with the sealing plate protruding from the blade along a circumferential direction, wherein said step of connecting is selected from the group consisting of welding, brazing and forming a sealing plate integrally with the blade; and connecting the blades to a rotor disc such that the blades extend radially from the disc, the deflector being formed when the sealing plate of each of the blades extends in front of an adjacent one of the blades.

2. The method as defined in claim 1, wherein the sealing plate of each of the blades is connected to a platform thereof.

* * * * *